US010382868B2

(12) United States Patent
Wu et al.

(10) Patent No.: US 10,382,868 B2
(45) **Date of Patent: *Aug. 13, 2019**

(54) MEMBRANE FOR SOUNDING DEVICE

(71) Applicant: AAC Technologies Pte, Ltd., Singapore (SG)

(72) Inventors: Meiwei Wu, Shenzhen (CN); Xiaojiang Gu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/891,469

(22) Filed: Feb. 8, 2018

(65) Prior Publication Data

US 2018/0367912 A1 Dec. 20, 2018

(30) Foreign Application Priority Data

Jun. 20, 2017 (CN) ..... 2017 2 0723754 U

(51) Int. Cl.
*H04R 7/12* (2006.01)
*G10K 13/00* (2006.01)
*H04R 31/00* (2006.01)

(52) U.S. Cl.
CPC ..... *H04R 7/127* (2013.01); *G10K 13/00* (2013.01); *H04R 31/003* (2013.01)

(58) Field of Classification Search
CPC ..... G10K 13/00; H04R 7/127; H04R 31/003; H04R 7/16; H04R 7/18; H04R 7/20; H04R 7/22; H04R 7/24; H04R 31/006; H04R 2307/204; H04R 2307/207
See application file for complete search history.

(56) References Cited

U.S. PATENT DOCUMENTS 6,957,714 B2 * 10/2005 Takahashi ..... H04R 7/20 181/171
7,946,378 B2 * 5/2011 Windischberger ..... H04R 7/20 181/157

* cited by examiner

*Primary Examiner* — Brian Ensey
(74) *Attorney, Agent, or Firm* — Na Xu; IPro, PLLC

(57) ABSTRACT

The present disclosure provides a membrane. The membrane includes a central dome part, and a suspension part surrounding the dome part. The suspension part includes a number of first reinforcing parts, a number of third reinforcing parts spacing from the first reinforcing parts, and an included angle formed between each third reinforcing part and an adjacent first reinforcing part. The third reinforcing part includes a second master extension part, a second slave extension part, and a connecting part connecting the second master extension part and the second slave extension part. The second master extension part and the second slave extension part locate at two ends of the connecting part respectively, and a width of at least one of the second master extension part and the second slave extension part is less than a width of the connecting part.

5 Claims, 2 Drawing Sheets

MEMBRANE FOR SOUNDING DEVICE

CROSS-REFERENCE TO RELATED APPLICATIONS

This application claims the priority benefit of Chinese Patent Application Ser. No. 201720723754.9 filed on Jun. 20, 2017, the entire content of which is incorporated herein by reference.

FIELD OF THE PRESENT DISCLOSURE

The present disclosure relates to electro-acoustic transducers, more particularly to a membrane of a sounding device for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

People not only pay attention to the miniaturized size and multi-function, but also expect such equipment have high-quality and distortion-free voice. As the membrane is the core component of the sounding device, its design affects the behaviors of acoustic devices directly.

The traditional membrane comprises the central dome part and the suspension part encircling the dome part, and the suspension part is a structure of a single pattern. However, due to its insufficient strength and even lower strength at the corner of the suspension part, such membranes tend to collapse.

Therefore it is necessary to provide an improved membrane for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
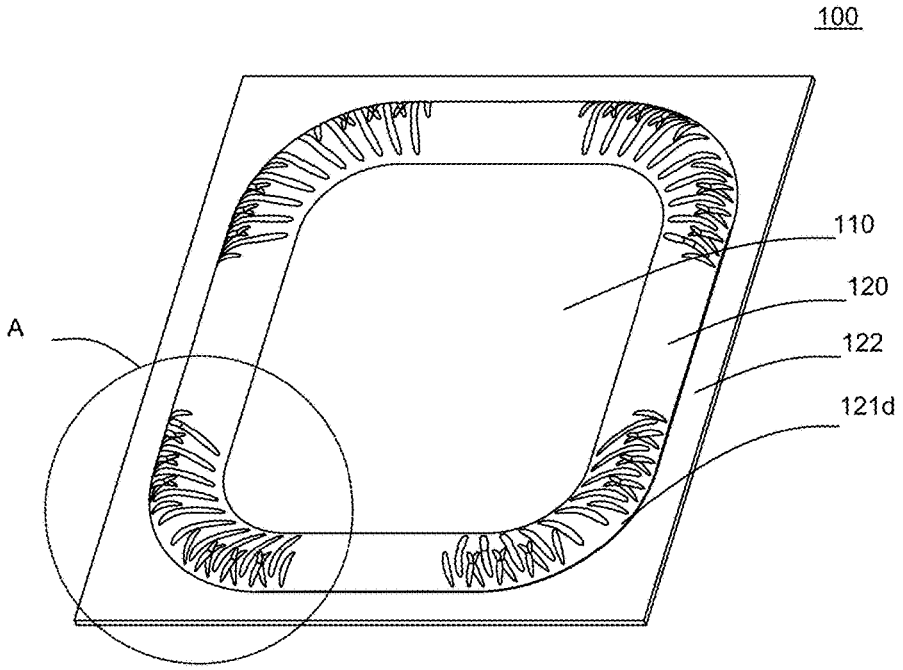
FIG. 1 is an illustrative isometric view of a membrane in accordance with an exemplary embodiment of the present disclosure.
Figure 2:
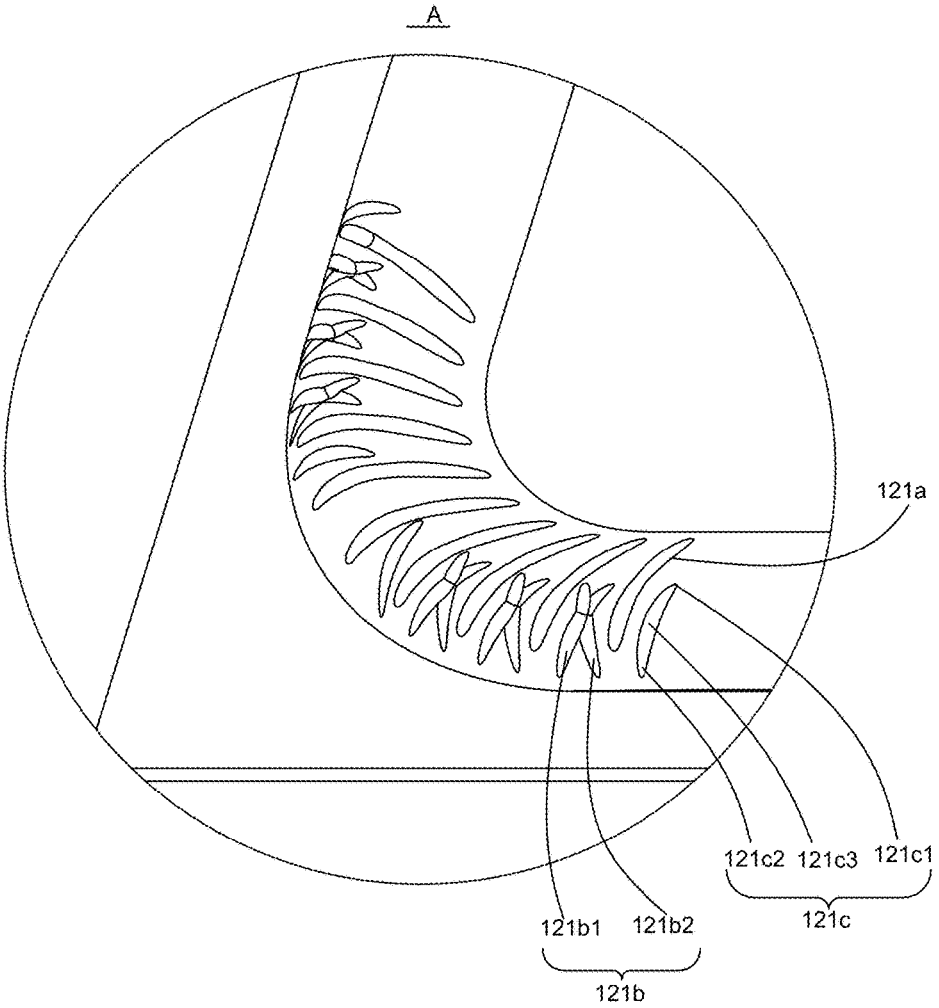
FIG. 2 is an enlarged view of Part A in FIG. 1.

As shown in FIG. 1 and FIG. 2, a membrane 100 is provided according to one embodiment of the present disclosure. The membrane 100 is mainly applied in the sounding device of electronic equipment. The sounding device typically comprises a magnetic circuit system and a vibration system. The magnetic circuit system comprises a yoke and a magnet accommodated in the yoke, and there is a magnetic gap between the yoke and the magnet. The vibration system comprises a voice coil suspended in the magnetic gap and the membrane 100 is connected with the voice coil and driven by the same to vibrate.

The membrane 100 comprises a central dome part 110, a suspension part 120 encircling the dome part 110 and a fixation part 122 extending outwards from the suspension part 120, where the suspension part 120 has an annular, protruding shape. That is to say, the suspension part 120 is provided to surround the central dome part 110.

The suspension part 120 is provided with a number of first reinforcing parts 121*a* and a number of second reinforcing parts 121*b* spaced from the first reinforcing parts 121*a*, which significantly improves the strength of the membrane 100, reduces the membrane collapsing, prolongs the life of the membrane and allows the sounding device using the membrane 100 to have an excellent vibration performance.

It should be noted that no limitation is made to the structures of the first reinforcing parts 121*a* and the second reinforcing parts 121*b*, for example, their protruding direction may be the same as that of the suspension part 120 or opposite to that of the suspension part 120; no limitation is made herein.

It should be understood that the first reinforcing parts 121*a* and the second reinforcing parts 121*b* are provided spaced from each other, which may include: the first reinforcing parts 121*a* and the second reinforcing parts 121*b* are alternately arranged one by one, or a (or more) second reinforcing part(s) 121*b* is arranged every one or more first reinforcing part(s) 121*a*, or other arrangements.

As shown in FIG. 2, the second reinforcing parts 121*b* comprise a first master extension part 121*b*1 and a first slave extension part 121*b*2, and the first master extension part 121*b*1 and the first slave extension part 121*b*2 cross with each other.

It should be understood that the crossing of the first master extension part 121*b*1 and the first slave extension part 121*b*2 may be as follows: the first master extension part 121*b*1 and the first slave extension part 121*b*2 cross at a point from which both parts extend to two sides, i.e. to roughly form a X shape, or the first master extension part 121*b*1 and the first slave extension part 121*b*2 cross at a point from which the first master extension part 121*b*1 extends to two sides and the first slave extension part 121*b*2 extends to one side, i.e. to roughly form a Y shape, or the first master extension part 121*b*1 and the first slave extension part 121*b*2 cross at a point from which the first master extension part 121*b*1 and the first slave extension part 121*b*2 extend to one side, i.e. to roughly form a V shape. Of course, the first master extension part 121*b*1 and the first slave extension part 121*b*2 may be configured to have other shapes, etc.

As shown in FIG. 1, the suspension part 120 roughly take a rectangular shape, both the first reinforcing parts 121*a* and the second reinforcing parts 121*b* may be located at the corner 121*d* of the suspension part 120, and both the first reinforcing parts 121*a* and the second reinforcing parts 121*b* extend from the outside of the corner 121*d* to the inside of the corner 121*d*. Wherein the inside of the suspension part 120 is the side close to the dome part 110, and its outside is the side away from the dome part 110.

In the membrane 100 of the structure according to the embodiment, the provision of the first reinforcing parts 121*a* and the second reinforcing parts 121*b* at the corner 121*d* of the suspension part 120 can effectively improve the strength of the membrane 100 at the corner 121*d* and reduce the collapsing of the membrane.

As shown in FIG. 2, in order to further improve the strength of the membrane 100, the suspension part 120 is also provided with a number of third reinforcing parts 121*c*. Wherein, each third reinforcing part 121*c* is provided spaced apart from the first reinforcing parts 121*a* and the second reinforcing parts 121*b*, and there is an included angle between each third reinforcing part 121*c* and the extension direction of its adjacent first reinforcing part 121*a*.

It should be understood that the included angle between the third reinforcing part 121*c* and the extension direction of its adjacent first reinforcing part 121*a* may be 0-90°, that is to say, the first reinforcing parts 121*a* may be in parallel with the third reinforcing parts 121*c*, or there may be an angle between the first reinforcing parts 121*a* and the third reinforcing parts 121*c*, for example, 45°.

In the membrane 100 of the structure according to the embodiment, the provision of the third reinforcing parts 121*c* on the suspension part 120 can further improve the strength of the membrane 100 and reduce the membrane collapsing.

As shown in FIG. 2, specifically, the third reinforcing part 121*c* comprises a second master extension part 121*c*1, a second slave extension part 121*c*2 and a connecting part 121*c*3 connecting the second master extension part 121*c*1 and the second slave extension part 121*c*2. Wherein, the second master extension part 121*c*1 and the second slave extension part 121*c*2 are located at two ends of the connecting part 121*c*3 respectively, and the width of at least one of the second master extension part 121*c*1 and the second slave extension part 121*c*2 is less than that of the connecting part 121*c*3.

It should be understood that the width of at least one of the second master extension part 121*c*1 and the second slave extension part 121*c*2 is less than that of the connecting part 121*c*3, which may be as follows: the width of the second master extension part 121*c*1 may be less than that of the connecting part 121*c*3, and the width of the second slave extension part 121*c*2 may be less than that of the connecting part 121*c*3, or the widths of both the second master extension part 121*c*1 and the second slave extension part 121*c*2 are less than that of the connecting part 121*c*3 which is preferable.

In the membrane 100 of the structure according to the embodiment, the width of at least one of the second master extension part 121*c*1 and the second slave extension part 121*c*2 is less than that of the connecting part 121*c*3, which can further improve the strength of the membrane 100 at the corner 121*d* and reduce the membrane collapsing; besides, the membrane 100 of the structure can be also easily fabricated and requires less cost.

As shown in FIG. 2, specifically, the structure of both the first reinforcing parts 121*a* and the third reinforcing parts 121*c* may be a depression part sinking in the surface of the suspension part 120.

Of course, another structure of both the first reinforcing parts 121*a* and the third reinforcing parts 121*c* may be a protrusion part rising from the surface of the suspension part 120.

In the membranes 100 of both structures described above, the strength of the membrane at the corner 121*d* can be effectively improved and the membrane collapsing is reduced. Taking the convenience of fabricating processes into consideration, the first reinforcing parts 121*a* and the third reinforcing parts 121*c* of the first structure are preferable, i.e. both the reinforcing parts are depression parts sinking in the surface of the suspension part 120.

In order to further improve the strength of the membrane, the corners 121*d* of the suspension 120 are rounded off.

A sounding device is provided according to the second aspect of the present disclosure (not shown in figures). The sounding device comprises a magnetic circuit system (not shown in figures), a vibration system (not shown in figures) and a frame accommodating the magnetic circuit system and the vibration system (not shown in figures), wherein the vibration system includes the membrane 100 described above.

The sounding device of the structure according to the embodiment includes the membrane 100 described above. The membrane 100 of such a structure has improved strength and does not collapse easily, so the life of the sounding device is prolonged and its vibration effect is improved.

An electronic equipment (not shown in figures) is provided according to the third aspect of the present disclosure, and the electronic equipment comprises the sounding device described above.

The electronic equipment of the structure according to the embodiment has the sounding device described above which has the membrane 100 described above, the vibration effect of the electronic equipment is effectively improved and the life of the product is prolonged.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A membrane, comprising:

a central dome part;

a suspension part surrounding the dome part, the suspension part including a plurality of first reinforcing parts, a plurality of third reinforcing parts spacing from the first reinforcing parts, an included angle formed between each third reinforcing part and an adjacent first reinforcing part; wherein the third reinforcing part comprises a second master extension part;

a second slave extension part;

a connecting part connecting the second master extension part and the second slave extension part;

the suspension part also includes a plurality of second reinforcing parts, the second reinforcing parts are spaced apart from the first reinforcing parts and the third reinforcing parts, the second reinforcing parts comprises a first master extension part and a first slave extension part, and the first master extension part and the first slave extension part crosses with each other;

the second master extension part and the second slave extension part locate at two ends of the connecting part respectively, and a width of at least one of the second master extension part and the second slave extension part is less than a width of the connecting part.

2. The membrane as described in claim 1, wherein both the first reinforcing parts and the third reinforcing parts are depressions sinking in a surface of the suspension part.

3. The membrane as described in claim 1, wherein both the first reinforcing parts and the third reinforcing parts are protrusions rising from a surface of the suspension part.

4. The membrane as described in claim 1, wherein both the first reinforcing parts and the second reinforcing parts are located at corners of the suspension part, and both the first reinforcing parts and the second reinforcing parts extend from an outside of the corner to an inside of the corner.

5. The membrane as described in claim 4, wherein the corners of the suspension part are rounded off.

* * * * *